United States Patent [19]

Thacker

[11] 3,983,924

[45] Oct. 5, 1976

[54] EJECTOR TYPE CORE MOLD

[76] Inventor: I. Reed Thacker, 1416 N. Hayes, Pocatello, Idaho 83201

[22] Filed: Sept. 26, 1973

[21] Appl. No.: 400,781

[52] U.S. Cl. ..... 164/262; 249/67

[51] Int. Cl.[2] ..... B22D 11/126; B28B 7/10

[58] Field of Search ..... 164/262; 249/162, 161, 249/170, 102, 171, 67

[56] References Cited

UNITED STATES PATENTS

| | | | |
|---|---|---|---|
| 705,146 | 7/1902 | Richter | 249/170 |
| 904,273 | 11/1908 | Mundt | 249/161 X |
| 936,475 | 10/1909 | Putney | 249/171 X |
| 1,608,333 | 11/1926 | Millican | 249/170 X |
| 1,763,977 | 6/1930 | McNeely | 249/161 X |
| 3,749,351 | 7/1973 | Lee | 249/170 |
| 3,870,272 | 3/1975 | Jackman | 249/170 |

*Primary Examiner*—Francis S. Husar
*Assistant Examiner*—John S. Brown
*Attorney, Agent, or Firm*—George R. Douglas, Jr.

[57] ABSTRACT

This device consist primarily of a main body with an extending handle, the top portion being pivotable upon a bolt and includes a second handle which is used to rotate the top member, the body including a sleeve and rod, the rod being adjustable within a bottom plate secured adjustablely to the main body by a threaded bolt.

3 Claims, 2 Drawing Figures

FIG. 1
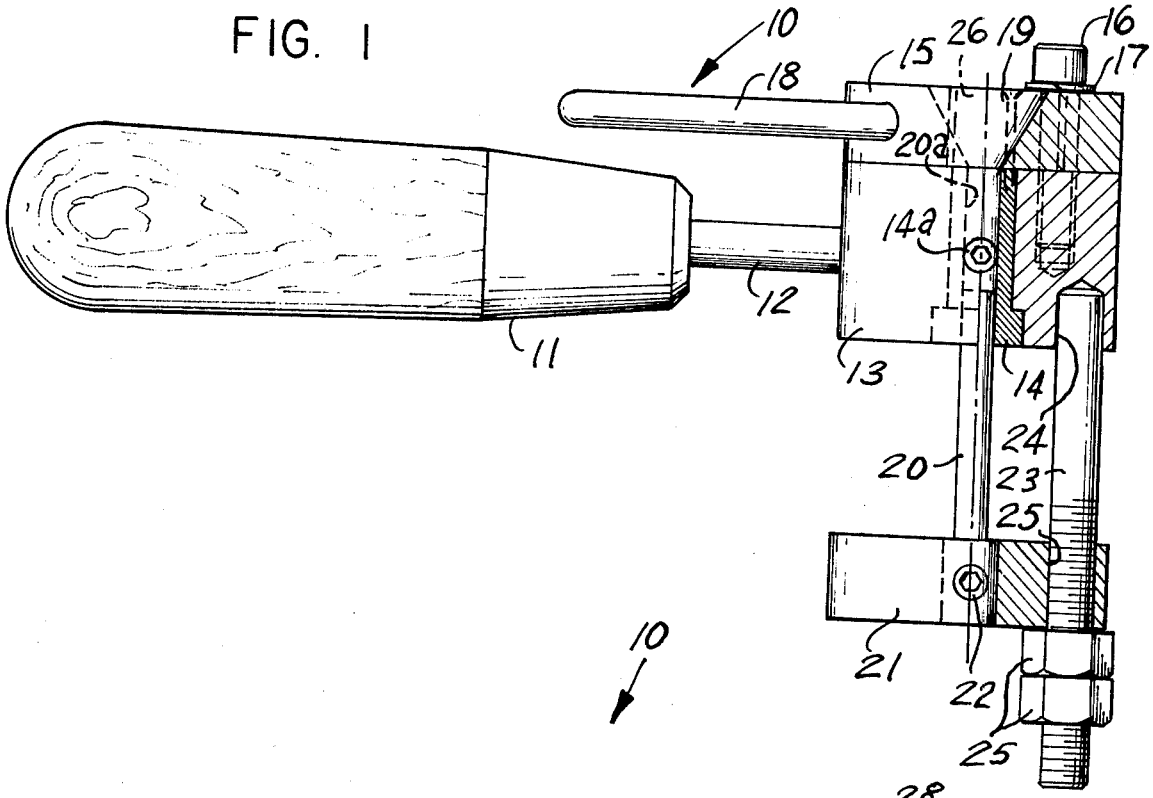
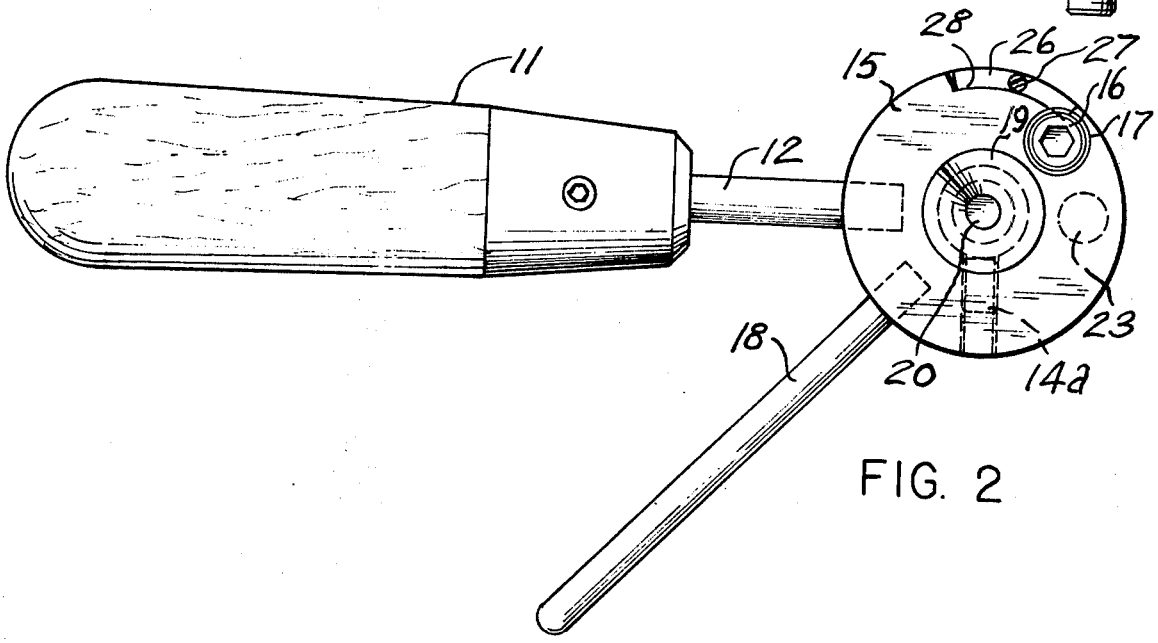
FIG. 2

EJECTOR TYPE CORE MOLD

BRIEF SUMMARY OF THE INVENTION

This invention relates to casting devices, and more particularly to an ejector type core mold.

It is therefore the principal object of this invention to provide a mold for casting lead cores of bullets.

FIELD OF THE INVENTION

Another object of this invention is to provide a mold which will be used for casting lead cores or pouring the lead directly into the jacket, or by using a metal insert placed in the jacket prior to the pouring so as to produce a hard core bullet.

Another object of this invention is to provide a mold which will have a simplified operation as compared to those of the prior art and the construction will be such, that it will eliminate foreign matter from getting into the mold block.

Yet another object of this invention is to provide a device of the type described which will be of such construction that no misalignment will take place and the cores produced may be of any weight and length desired.

A further object of this invention is to provide a device of the type described in which cores can be poured directly into jackets held in the mold, thus eliminating two operations in swaging bullets and the jackets may be trimmed to any length desired so that bullets of different weights in the same caliber can be poured. The hard cored bullets are produced by placing steel inserts into jackets prior to the lead being poured and jackets made of copper tubing, die formed or with base inserts may also be poured into the device.

A still further object of this invention is to provide a device of the type described which will have bullet ejecting means consisting of the bottom plate being moved upwards and the device will include stop means for the cutting portion of the structure.

Other objects of the invention are to provide an ejector type core mold which is simple in design, inexpensive to manufacture, rugged in construction, easy to use and efficient in operation.

BRIEF DESCRIPTION OF THE SEVERAL VIEWS OF THE DRAWINGS

These and other objects will be readily evident upon a study of the following specification and the accompanying drawing, wherein:

FIG. 1 is a side view of the present invention shown partly broken away, the device also being shown in elevation;

FIG. 2 is a top plan view of FIG. 1.

DETAILED DESCRIPTION OF A PREFERRED EMBODIMENT OF THE INVENTION

Referring now to the drawings, a mold 10 is shown to include a handle 11 by which the stem 12 is secured fixedly within a circular metal body 13. A sleeve 14 is carried within the longitudinal axis of body 13 and a screw 14*a* secures sleeve 14 therein.

A flat and cylindrical sprue cutter 15 is secured above body 13 by means of bolt 16 and lock washers 17. Bolt 16 is threadably carried within the body 13 of device 10 and sprue cutter 15 includes an extending handle 18 providing handle grip means for rotating sprue cutter 15. The conical opening 19 through sprue cutter 15 allows for the easy pouring of the lead into the body 13 of mold 10. A punch 20 is carried within the opening 20*a* of sleeve 14 and serves as adjustable link means for the lead being cast within mold 10. The end of punch 20 is secured within bottom plate 21, by means of set screw 22. An externally threaded guide rod 23 is secured within opening 24 of body 13 and threadably carries a pair of adjustment nut fasteners 25 which enables plate 21 to be brought towards or away from body 13. A stop member 26 is secured fixedly to body 13 by means of screw fastener 27 and thus serves as stop means for the rotation of sprue cutter 15, the stop 26 enabling the opening 19 to align correctly with opening 20*a* of bushing 14.

It will be noted that stop member 26 is thrushed with the top of sprue cutter 15 and is freely received within the cut-off 28 of sprue cutter 15.

When the sprue cutter 15 is in closed position, the opening 19 aligns with opening 20*a* of bushing 14 and the punch 20 is adjusted for the length of core desired. The molded lead is poured into mold 10 until it fills the sprue cutter 15. The sprue cutter 15 is opened by means of the handle 18 which is pivoted away from the handle 11 of mold 10. After the aforementioned is accomplished, the bottom plate 21 is moved upwards through to eject the molded lead core. Adjustments to control the length of the core are made by means of the nut fasteners 25 on the guide rod 23. Pouring lead into bullet jackets requires a punch and sleeve of the right size for the jacket being used and then adjusting the jacket in the mold 10 until it just clears sprue cutter 15 when using steel inserts in the jackets, the inserts are made in size and shape desired to snug fit inside the jacket and to be seated to the bottom of the jacket prior to filling the mold 10 with lead.

What I claim now is:

1. An ejector type core mold comprising a cylindrical main body, a handle fixedly carried by said main body, a sprue cutter device pivotably carried by said main body with handle means for rotating it, removeable bushing sleeve means carried within said main body, punch means carried by said bushing sleeve means, a bottom plate carried by said mold with securing means for said punch means, a guide rod carried by said bottom plate and said main body with adjustment means for elevation thereof, said sprue cutter device including said handle and a frusto-conical opening disposed therein, said sprue cutter device being pivotally carried by a bolt secureably therein, said main body of said mold and a stop member carried by said main body secured fixedly thereto by fastener means, said stop member abutting with a cut out portion of said sprue cutter device for preventing misalignment with the opening of said bushing sleeve means within said body and said opening of said sprue cutter, said bottom plate carrying said punch means, said punch means being secured fixedly when cores are molded within said body, said punch means being adjustable by said guide rod, one end of said punch means being secured within said bottom plate, and said guide rod being threaded into said plate and carried within an opening of said body of said mold.

2. The invention of claim 1 wherein said adjustment means is a set screw.

3. The invention of claim 1 wherein a stem member is interposed between said main body and its handle.

* * * * *